US006334529B1

(12) United States Patent
Franey

(10) Patent No.: US 6,334,529 B1
(45) Date of Patent: Jan. 1, 2002

(54) CORROSION PROTECTION SYSTEM FOR ANTI-TANK AMMUNITION

(75) Inventor: John P. Franey, Bridgewater, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/477,834

(22) Filed: Jan. 5, 2000

(51) Int. Cl.[7] ..... F24B 39/00
(52) U.S. Cl. ..... 206/3; 102/293
(58) Field of Search ..... 89/30, 1.8, 34; 206/3; 102/282

(56) References Cited

U.S. PATENT DOCUMENTS 3,559,872 A * 2/1971 Riboud
3,731,585 A * 5/1973 Demberg et al.
4,532,997 A * 8/1985 Atherton
4,733,773 A * 3/1988 LaBianca et al.
4,785,930 A * 11/1988 Fischer et al.
4,979,632 A * 12/1990 Lee
5,212,337 A * 5/1993 Patteri et al.
5,429,268 A * 7/1995 Hale et al.
5,611,424 A * 3/1997 Sniezek et al. .....

* cited by examiner

*Primary Examiner*—Charles T. Jordan
*Assistant Examiner*—Troy Chambers
(74) *Attorney, Agent, or Firm*—Duane Morris & Heckscher LLP

(57) ABSTRACT

An apparatus for storing anti-tank ammunition including a tube with a first cap disposed at a first end of the tube, and a second cap disposed at a second opposing end of the tube. The first cap includes a one-way valve which allows gas to escape the tube, but which prevents gas from entering the tube. The apparatus reduces the amount of corrosion which forms on the ammunition, thereby substantially lowering the number of backfires of the ammunition.

16 Claims, 4 Drawing Sheets

CORROSION PROTECTION SYSTEM FOR ANTI-TANK AMMUNITION

FIELD OF THE INVENTION

The present invention relates to ammunition, and in particular, a system for protecting anti-tank ammunition from corrosion.

DESCRIPTION OF THE RELATED ART

Many defensive vehicles carry ammunition or rounds which are fired from the vehicle during a combat situation. For example, tanks often carry various rounds which are stored within the tank prior to being fired from a gun turret of the tank.

One example of a round carried by most tanks is a 105 millimeter (mm) anti-tank round. An exemplary anti-tank round 10 is shown in FIG. 1. The round 10 includes two basic parts: a shell casing 20 and a uranium dart tip 30. The uranium dart tip 30 is bonded to the shell casing 20 by a lead packing material 40.

Tanks which carry rounds, such as round 10 described above, often include metal (e.g. steel) tubes disposed therein for carrying the rounds when they are not in use. FIG. 2 shows a conventional ammunition storage system 15 which includes a metal tube 50 for storing an ammunition round, such as round 10. The metal tube 50 is preferably mounted to the inner wall of the tank so that the tube is disposed parallel to the floor of the tank, as shown by the arrow in FIG. 2. Rounds, such as the anti-tank round 10 described above, are initially placed into the metal tube 50 by sliding a dart end 11 of the round into a rear end 52 of the tube. The round 10 is then moved forward in the metal tube 50 until the dart end 11 of the round extends from a front end 51 of the tube. The round 10 remains stored in the metal tube 50 until it is needed for firing from the gun turret of the tank. When the round 10 is needed for firing, it is removed from the tube 50 in the same manner in which it was inserted.

A problem associated with the above ammunition storage system 15 is that galvanic corrosion often occurs on the rounds 10 while they are disposed in the tank due to the temperature difference between the interior tank walls and the inside air temperature of the tank. The cool walls present inside the tank as compared to the warm air present inside the tank often causes condensation to form inside the tank. This condensation causes galvanic corrosion to form at the point of the rounds where the uranium dart tip 30 and the shell casing 20 come together (i.e. where the lead packing material 40 is located). When rounds 10 with significant corrosion are attempted to be fired from the gun turret of the tank, the gun turret will backfire, causing damage to the interior of the tank and its occupants.

Thus, there is currently a need for a system for protecting anti-tank rounds from corrosion.

SUMMARY OF THE INVENTION

The present invention is an apparatus including a tube with a first cap disposed at a first end of the tube, and a second cap disposed at a second opposing end of the tube. The first cap includes a one-way valve which allows gas to escape the tube, but which prevents gas from entering the tube.

The above and other advantages and features of the present invention will be better understood from the following detailed description of the preferred embodiments of the invention which is provided in connection with the accompanying drawings.

BRIEF DESCRIPTION OF THE DRAWINGS

FIG. 4(*b*) is a side elevational view of a rear cap of the ammunition storage system according to the exemplary embodiment of the present invention.

DETAILED DESCRIPTION

Figure 1:
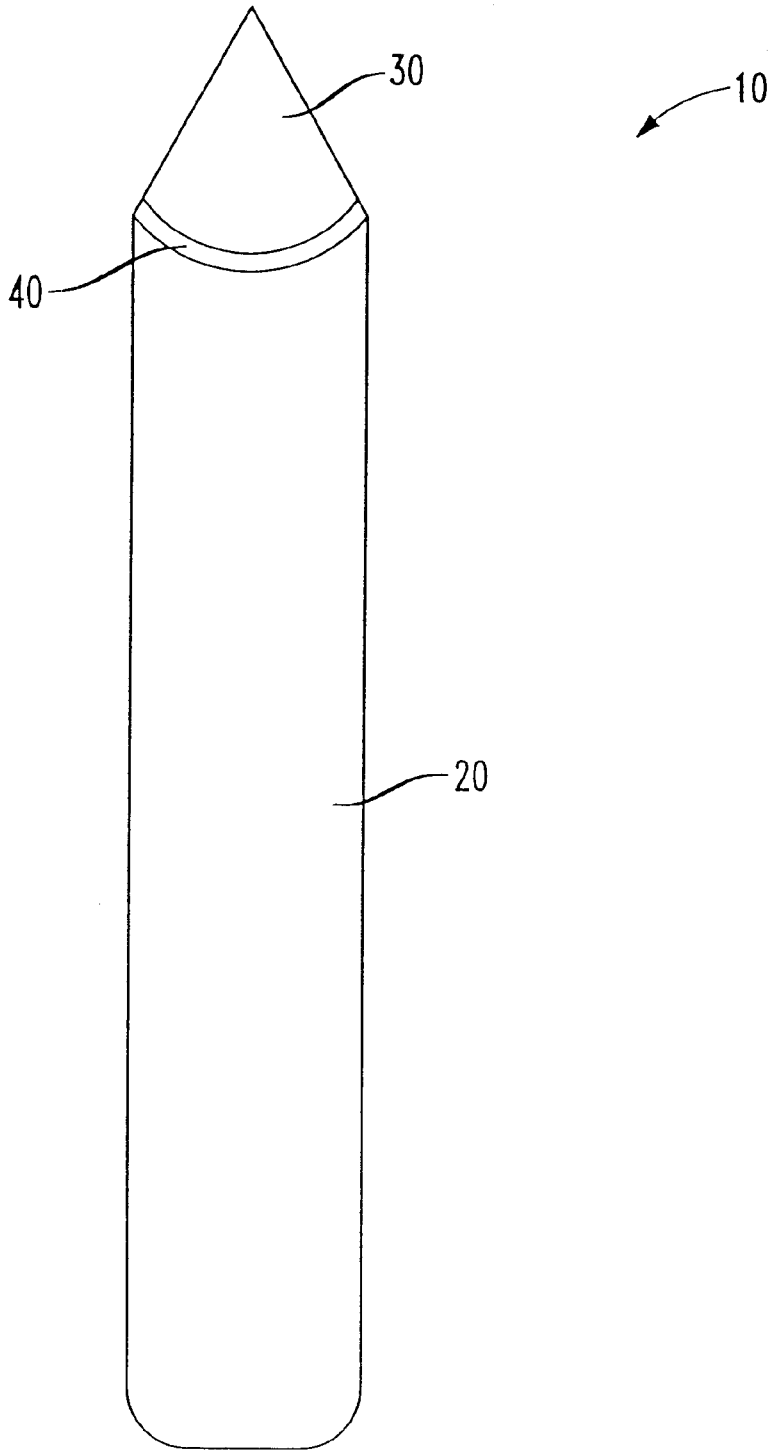
FIG. 1 PRIOR ART
FIG. 1 is an isometric view of a conventional anti-tank round.
Figure 3:
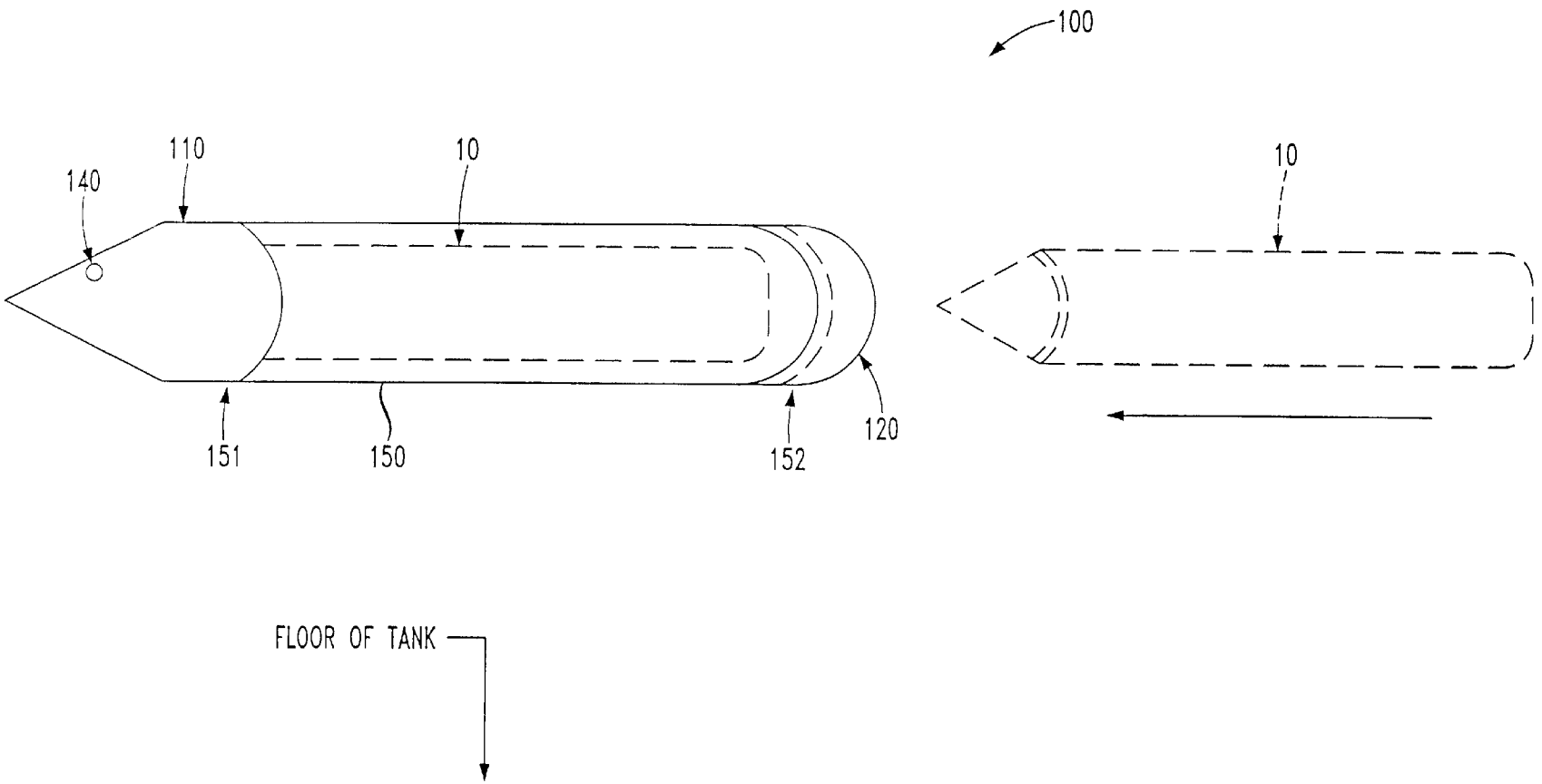
FIG. 3 is an isometric view of an ammunition storage system according to an exemplary embodiment of the present invention.

Referring to FIG. 3, there is shown an ammunition storage and protection system 100 according to an exemplary embodiment of the present invention. The system includes a metal tube 150 which includes a front cap 110 and a rear cap 120. The metal tube 150 is preferably substantially cylindrical with an interior portion capable of storing an ammunition round 10, such as the one shown in FIG. 1 of the present application. The front cap 110 is preferably substantially cone-shaped with an annular groove 111 (see FIG. 4(*a*)) which fits over a front end 151 of the metal tube. The front cap 110 includes a one-way check valve 140 which prevents gas (e.g. air) from entering the metal tube 150, but which allows air to escape the tube. The rear cap 120 is preferably a substantially cylindrical member which fits over the rear end 152 of the metal tube 150. The rear cap 120 also includes an annular groove 121 which fits onto the rear end 152 of the metal tube 150. The front 110 and rear 120 caps are preferably made of plastic, but may be made of any suitable material known to those skilled in the art. Preferably, the front 110 and rear 120 caps are made of a static electric charge reducing material and/or a corrosion reducing material (e.g., a material produced under the trademark STATIC INTERCEPT by Engineered Materials, Inc. of Buffalo Grove, Ill. 60089).

Figure 4A:
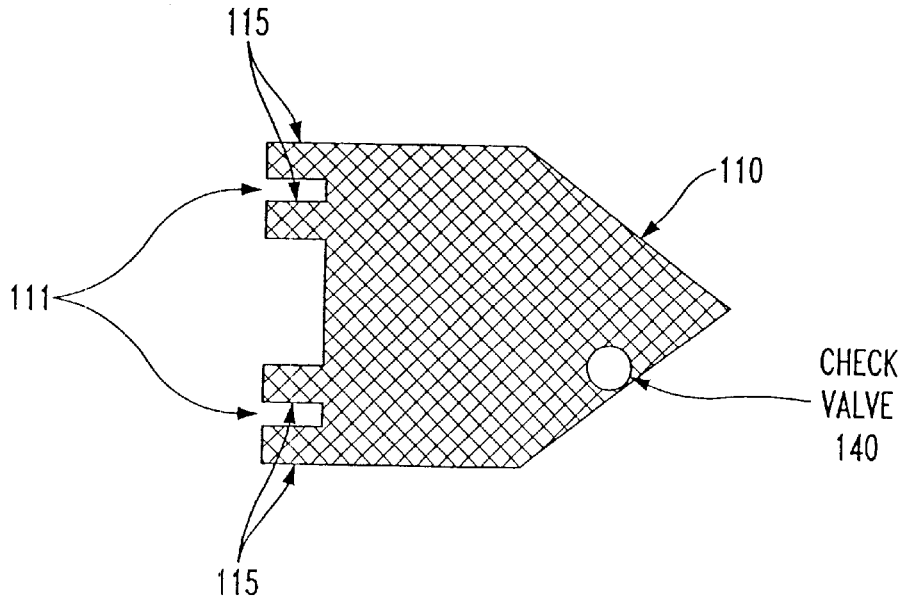
FIG. 4(*a*) is a side elevational view of a front cap of the ammunition storage system according to the exemplary embodiment of the present invention.
Figure 4B:
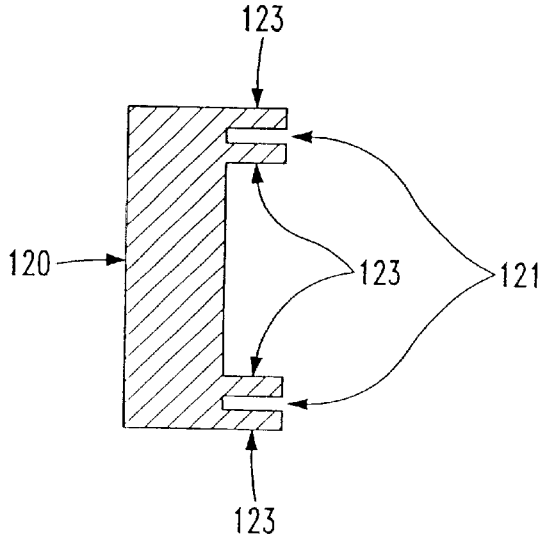

FIG. 4(*a*) shows a side elevational view of the front cap 110. As can be seen, the front cap 110 includes members 115 extending from one side thereof for forming the annular groove 111. As stated above, the annular groove 111 assists in affixing the front cap 110 to the metal tube 150 which holds the ammunition round 10.

FIG. 4(*b*) shows a side elevational view of the rear cap 120. As can be seen, the rear cap 120 includes members 125 extending from one side thereof for forming the annular groove 121. As stated above, the annular groove 121 assists in affixing the front cap 120 to the metal tube 150 which holds the ammunition round 10.

Figure 2:
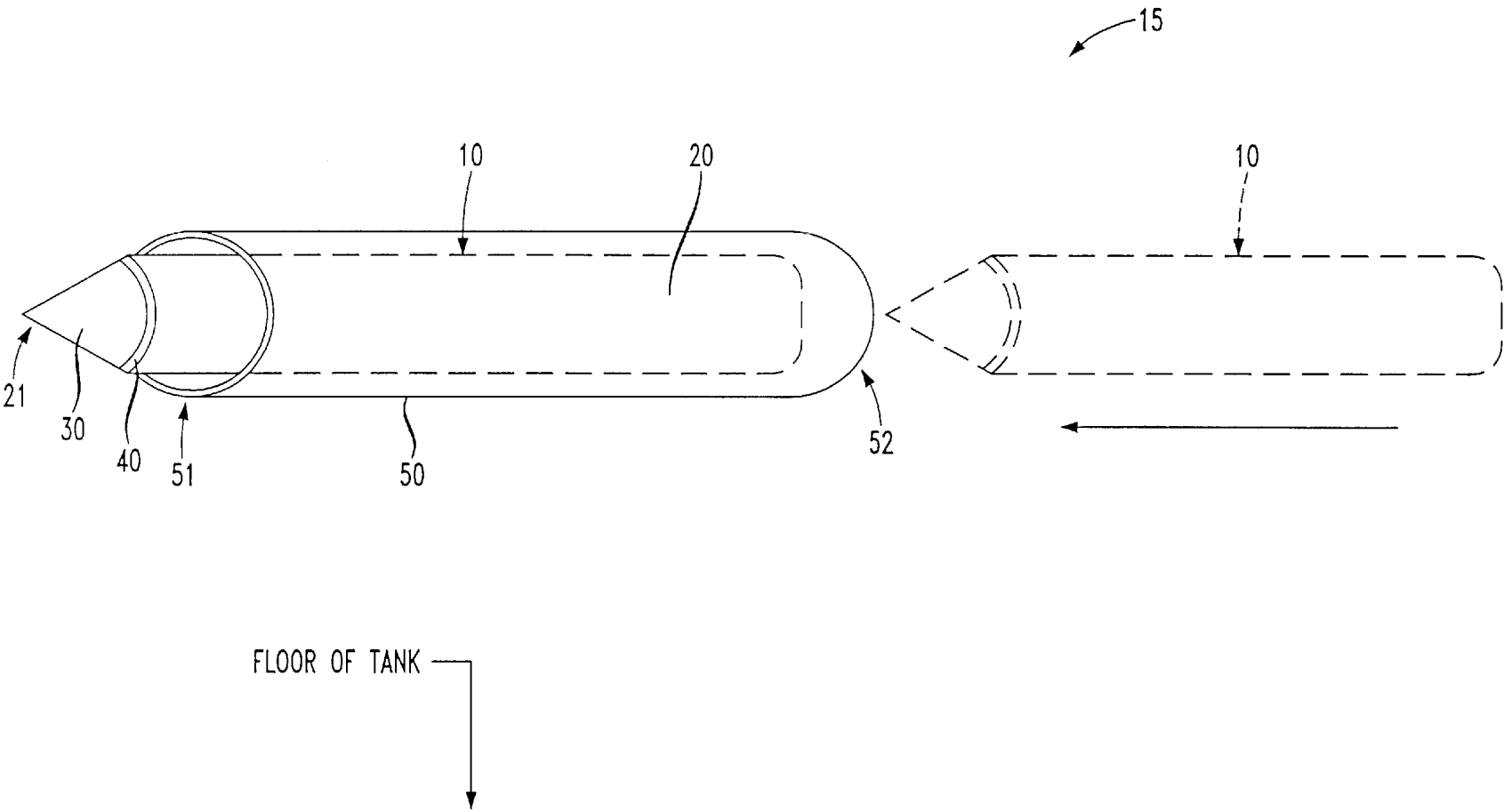
FIG. 2 PRIOR ART
FIG. 2 is an isometric view of a conventional ammunition storage system for the anti-tank round of FIG. 1.

Existing conventional metal tubes 50, such as the one shown in FIG. 2 of the present application, can be modified to create a ammunition storage and protection system 100 as described above. For example, a conventional metal tube 50 can be modified by sliding the front cap 110 through the tube from the rear side 52. As the front cap 110 is pushed through the tube 50 and emerges from the front side 51 of the tube, the annular groove 111 of the front cap slides over the rim of the front end 51 of the tube and is engaged thereby. Alternatively, the front cap 110 may be pressed onto the front side of the tube from the front side. Then, once the round 10 has been loaded into the tube 50, the rear cap 120 may be affixed to the tube by pressing it against the rear end 52 of the tube so that the annular groove 121 engages (slides over) the rim of the rear end of the tube.

In operation, the ammunition storage and protection system 100 is disposed in a tank or other defensive vehicle. To begin the loading process, the rear cap 120 is removed from one of the metal tubes 150 disposed in the tank. Then, a round 10 is pushed into the tube 150 from the rear side 152 towards the front side 151, with the front end of the round facing the front cap 110. Once the round 10 has bee inserted completely in the metal tube 150, the rear cap 120 is replaced. As the round 10 is being inserted, the one-way check valve allows gas (e.g. air) to escape the metal tube, thereby removing excess gas from the tube and preventing the front cap from becoming dislodged due to the force of gas through the tube during insertion. The removal of gas from the tube 150 significantly reduces the condensation which occurs in the tube 150, and thus significantly reduces corrosion of the round 10. Additionally, the front 110 and rear 120 caps substantially prevent condensation occurring inside the tank from entering the tube 150 during storage, and thereby causing corrosion of the round 10. When the round 10 is required to be loaded into the tank gun, the rear cap 120 is removed and the round is extracted from the tube 150 and placed into the gun. Accordingly, the round 10 is protected from condensation and other external elements which can cause corrosion at all times during storage in the tank. Hence, the ammunition storage and protection system 100 of the exemplary embodiment of the present invention substantially reduces corrosion of rounds which are stored therein, and thus significantly reduces or eliminates the possibility of a backfires.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. An apparatus comprising:

a tube;

a first cap disposed at a first end of the tube, said first cap including a one-way valve which allows gas to escape the tube, but which prevents gas from entering the tube; and, a second cap disposed at a second opposing end of the tube.

2. The apparatus of claim 1, further comprising:

a round of ammunition disposed within the tube, wherein said first and second caps protect said round of ammunition from corrosion.

3. The apparatus of claim 1, wherein the first and second caps are made of a static electric charge reducing material.

4. The apparatus of claim 1, wherein the first and second caps are made of a corrosion reducing material.

5. The apparatus of claim 1, wherein the tube is made of metal and the first and second caps are made of plastic.

6. An apparatus for reducing corrosion of ammunition comprising:

a tube having at least one piece of ammunition disposed therein;

a first cap disposed at a first end of the tube, said first cap including a one-way valve which allows gas to escape the tube, but which prevents gas from entering the tube; and, a second cap disposed at a second opposing end of the tube.

7. The apparatus of claim 6, wherein the first and second caps are made of a static electric charge reducing material.

8. The apparatus of claim 6, wherein the first and second caps are made of a corrosion reducing material.

9. The apparatus of claim 6, wherein the tube is made of metal and the first and second caps are made of plastic.

10. A method of protecting ammunition from corrosion comprising the steps of:

disposing the ammunition in a tube, said tube including a first cap with a one-way valve which allows gas to escape the tube, but which prevents gas from entering the tube; and, placing a second cap on a second opposing end of the tube in order to substantially seal the ammunition within the tube and protect the ammunition from corrosion.

11. The method of claim 10, wherein the first and second caps are made of a static electric charge reducing material.

12. The method of claim 10, wherein the first and second caps are made of a corrosion reducing material.

13. A method of making an ammunition storage apparatus comprising the steps of:

disposing a first cap on a first end of ammunition storage housing, said first cap including a one-way valve for allowing gas to exit the tube but not enter; and, disposing a second cap on a second opposing end of the ammunition storage housing.

14. The method of claim 13, wherein the ammunition storage housing comprises a metal tube.

15. The method of claim 13, wherein the first and second caps are made of a static electric charge reducing material.

16. The method of claim 13, wherein the first and second caps are made of a corrosion reducing material.

* * * * *